US005902196A

United States Patent [19]

Chorneyko

[11] Patent Number: 5,902,196

[45] Date of Patent: May 11, 1999

[54] FOLDABLE GOAL NET SUPPORT

[75] Inventor: Roy Chorneyko, St. Albert, Canada

[73] Assignee: Jiffy Net Co. Ltd., St Albert, Canada

[21] Appl. No.: 08/999,152

[22] Filed: Dec. 29, 1997

[51] Int. Cl.[6] ..... A63B 63/00

[52] U.S. Cl. ..... 473/478

[58] Field of Search ..... 473/478; 273/400

[56] References Cited

U.S. PATENT DOCUMENTS

| | | | |
|---|---|---|---|
| 2,449,708 | 9/1948 | Lindsay | 473/478 |
| 2,549,573 | 4/1951 | Clark . | |
| 2,794,357 | 6/1957 | Lykins, Jr. . | |
| 3,380,767 | 4/1968 | Barth . | |
| 3,563,592 | 2/1971 | Preston . | |
| 3,642,282 | 2/1972 | Frischman | 473/478 |
| 3,698,715 | 10/1972 | Browning et al. | 473/478 |
| 5,372,368 | 12/1994 | Pavonetti . | |
| 5,539,957 | 7/1996 | Schmidt . | |
| 5,586,768 | 12/1996 | Pavonetti . | |

*Primary Examiner*—William H. Grieb
*Attorney, Agent, or Firm*—Davis and Bujold

[57] ABSTRACT

A foldable goal net support includes a first side section, a second side section, a front section, and a rear section. The front section includes a first front member, a second front member, and a front spacer member disposed between the first front member and the second front member. The rear section includes a first rear member, a second rear member, and a rear spacer member disposed between the first rear member and the second rear member. The front section and the rear section are hinged for pivotal movement about a substantially vertical axis to the first side section and the second side section. A brace member extends between the front section and the rear section to rigidly support the structure.

11 Claims, 11 Drawing Sheets

FOLDABLE GOAL NET SUPPORT

FIELD OF THE INVENTION

The present invention relates to a foldable goal net support suitable for use with games such as hockey and soccer.

BACKGROUND OF THE INVENTION

Goal net supports used with hockey and soccer goals generally consist of a rigid structure that is bulky to transport or store when not in use.

U.S. Pat. No. 5,539,957 which issued to Schmidt in 1996 discloses a foldable goal net support. This goal net support relies for its utility upon a special lockable hinge mechanism. This lockable hinge mechanism increases the complexity of the goal net support and unavoidably increases the cost of manufacture. It is also comparatively time consuming to set up as a locking cuff must be manipulated to set each lockable hinge in a locked condition.

SUMMARY OF THE INVENTION

What is required is an alternative configuration of goal support net that is capable of folding for ease of transport, storage, and assembly.

According to the present invention there is provided a foldable goal net support which includes a rigid first side section, a rigid second side section, a front section, and a rear section. The first side section has a vertically extending portion terminating in a top end and a horizontally extending portion terminating in a bracket attachment end. The second side section has a vertically extending portion terminating in a top end and a horizontally extending portion terminating in a bracket attachment end. The front section is provided which includes a first front member, a second front member, and a front spacer member disposed between the first front member and the second front member. A first end of the first front member is hinged for pivotal movement about a substantially horizontal axis at the top end of the first side section. A first end of the second front member is hinged for pivotal movement about a substantially horizontal axis at the top end of the second side section. A second end of the first front member is hinged for pivotal movement about a substantially horizontal axis to a first end of the front spacer member. A second end of the second front member is hinged for pivotal movement about a substantially horizontal axis to a second end of the front spacer member. The rear section is provided which includes a first rear member, a second rear member, and a rear spacer member disposed between the first rear member and the second rear member. A first end of the first rear member is hinged for pivotal movement about a substantially horizontal axis at the bracket attachment end of the first side section. A first end of the second rear member is hinged for pivotal movement about a substantially horizontal axis at the bracket attachment end of the second side section. A second end of the first rear member is hinged for pivotal movement about a substantially horizontal axis to a first end of the rear spacer member. A second end of the second rear member is hinged for pivotal movement about a substantially horizontal axis to a second end of the rear spacer member. Means is provided to brace the front section and the rear section to assume an operative position defining a substantially rectangular opening.

The foldable goal net support, as described above, can be set up in a matter of seconds. The front section and rear section are pivoted relative to the side sections until the goal net support assumes an operative position defining substantially rectangular opening. It is preferred that a brace be positioned between the front section and the rear section to keep the structure rigid.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

Figure 1:
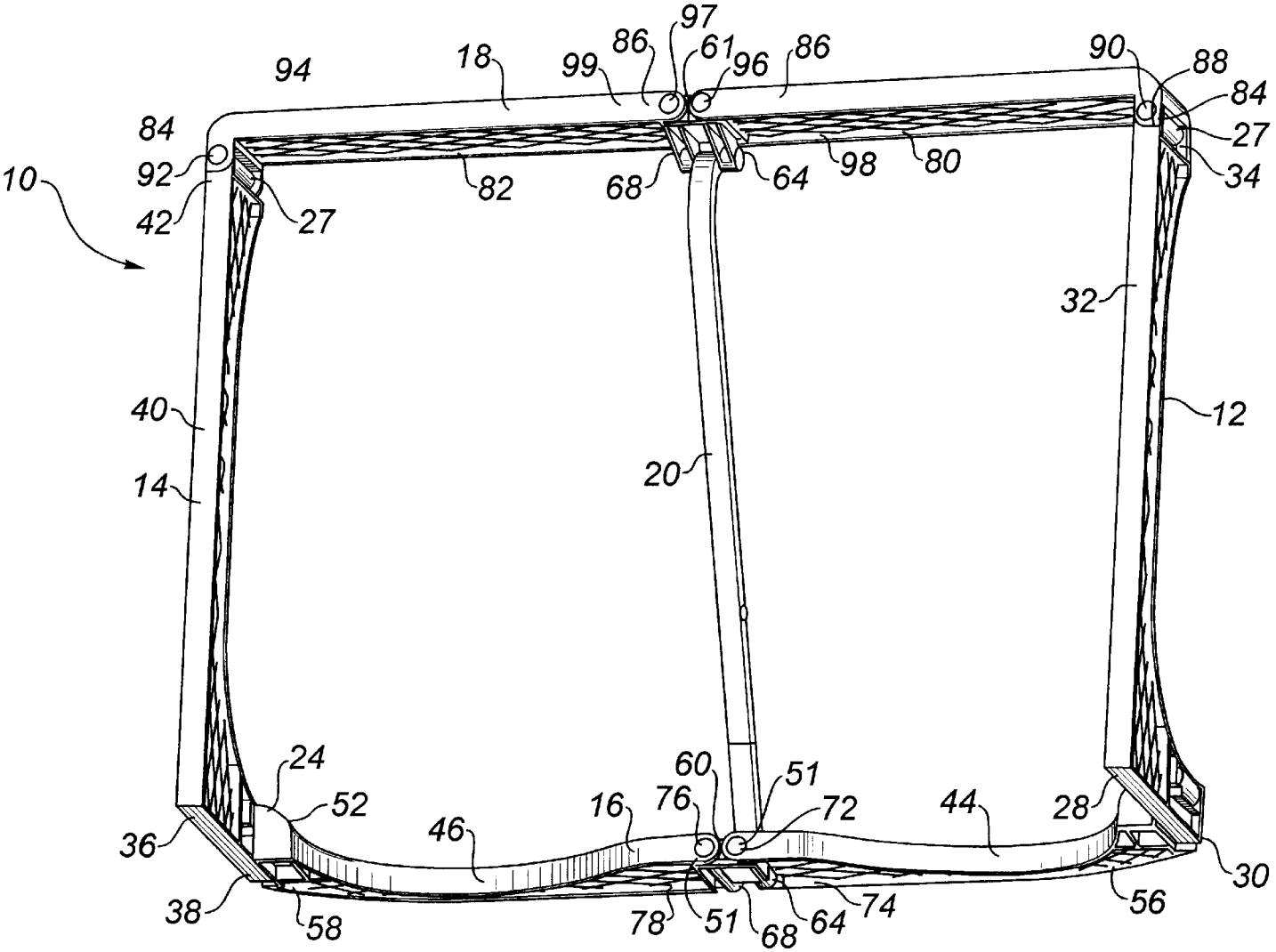
FIG. 1 is a lower perspective view of a foldable goal net support constructed in accordance with the teachings of the present invention, in an operative position.
Figure 2:
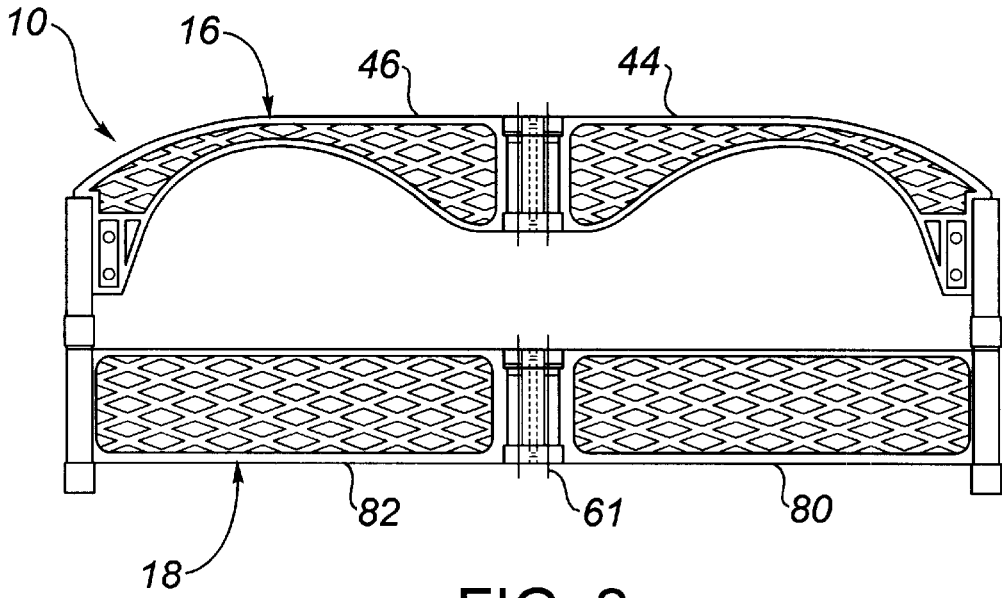
FIG. 2 is a top plan view of a foldable goal net support illustrated in FIG. 1.

The preferred embodiment, a foldable goal net support generally identified by reference numeral 10, will now be described with reference to FIGS. 1 through 13.

Figure 3:
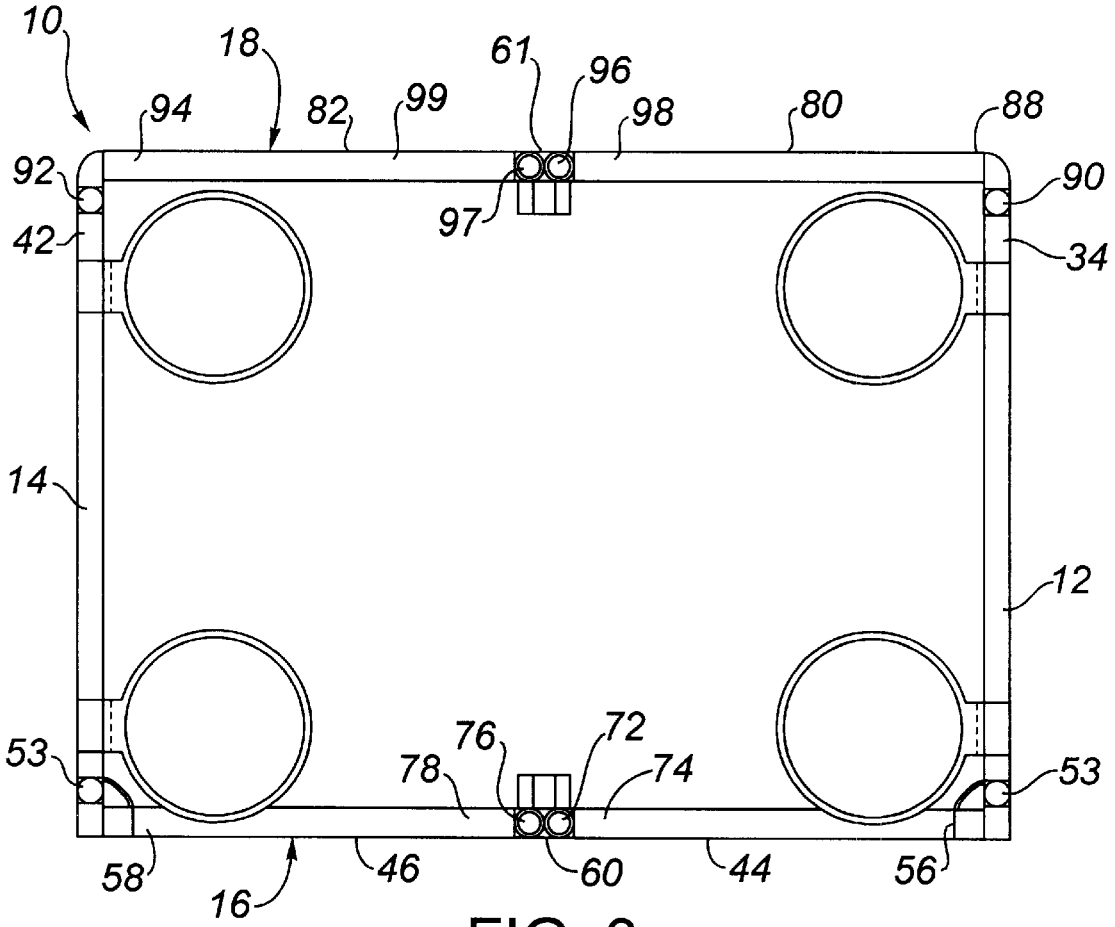
FIG. 3 is a front elevation view of the foldable goal net support illustrated in FIG. 1, with mounted targets.
Figure 6:
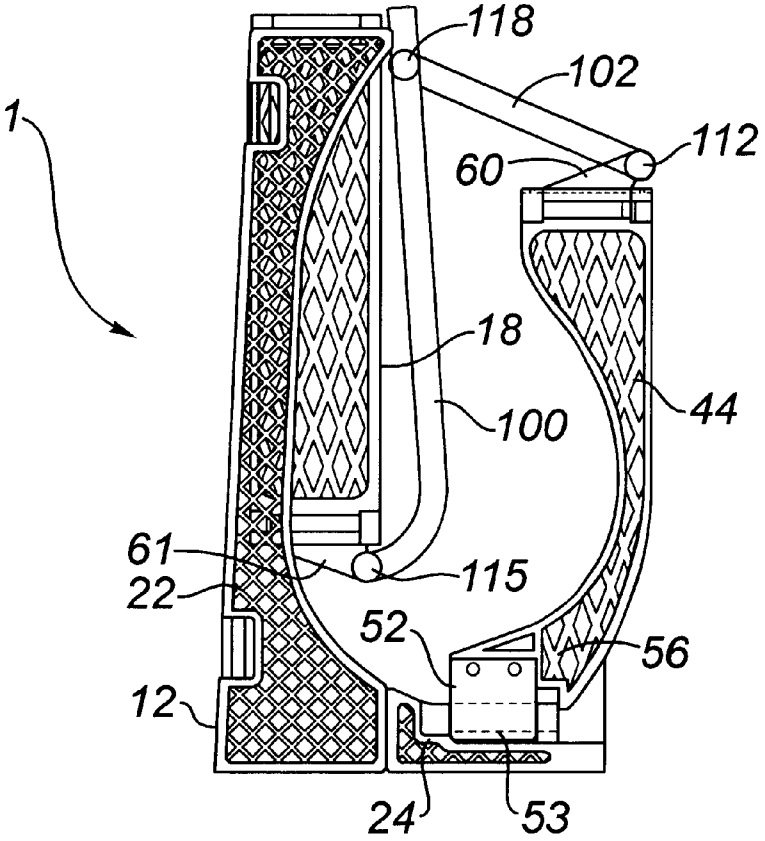
FIG. 6 is a side elevation view of the foldable goal net support illustrated in FIG. 5.
Figure 7:
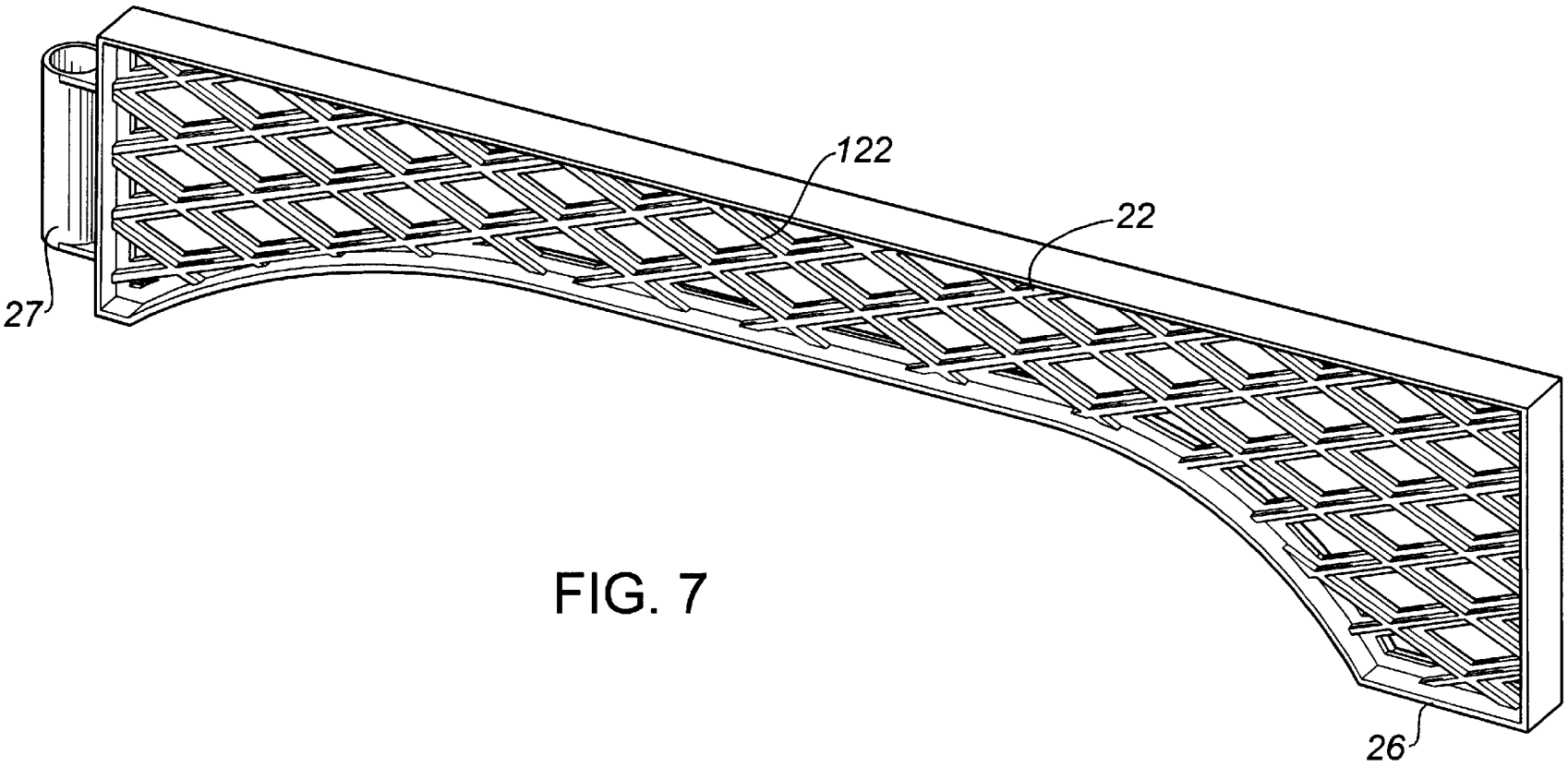
FIG. 7 is a perspective view of a side section from the foldable goal net support illustrated in FIG. 1.
Figure 8:
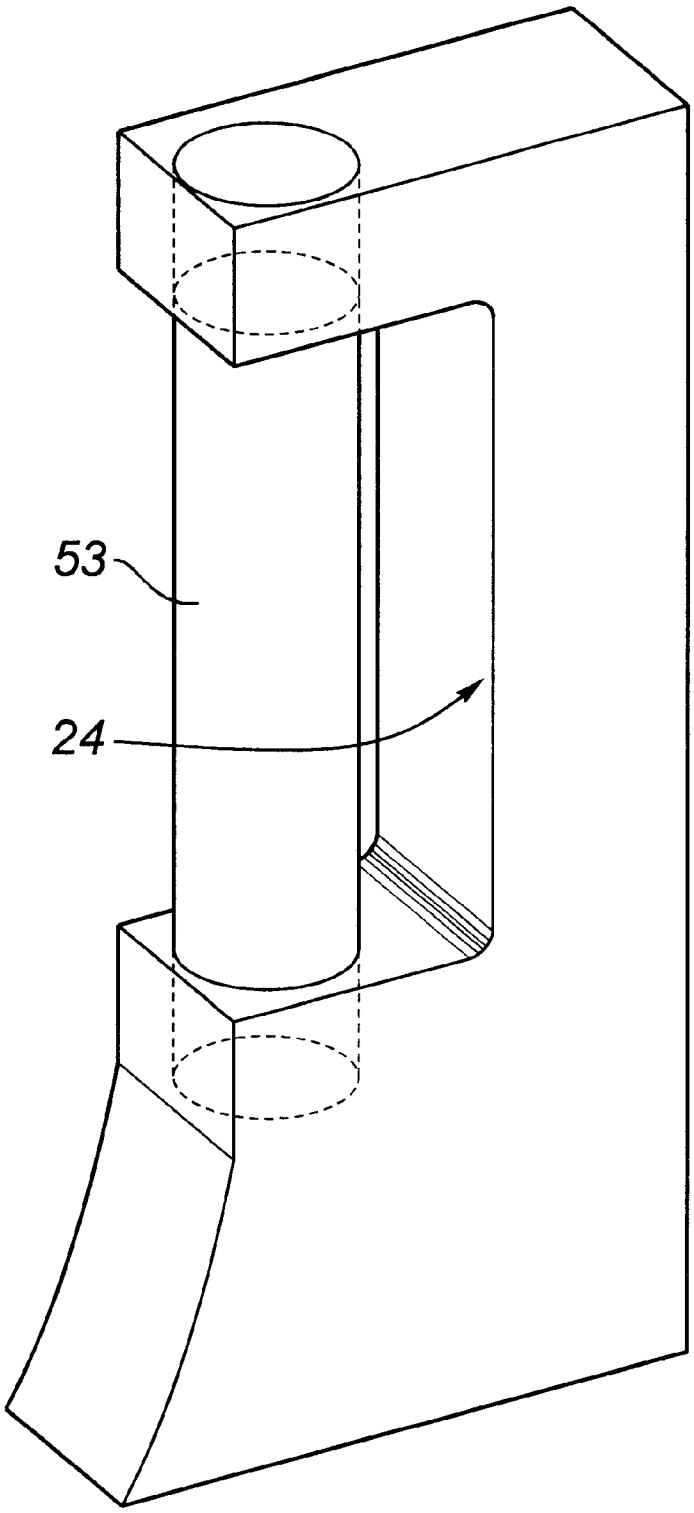
FIG. 8 is a detailed perspective view of a hinge bracket for a side section from the foldable goal net support illustrated in FIG. 1.
Figure 9:
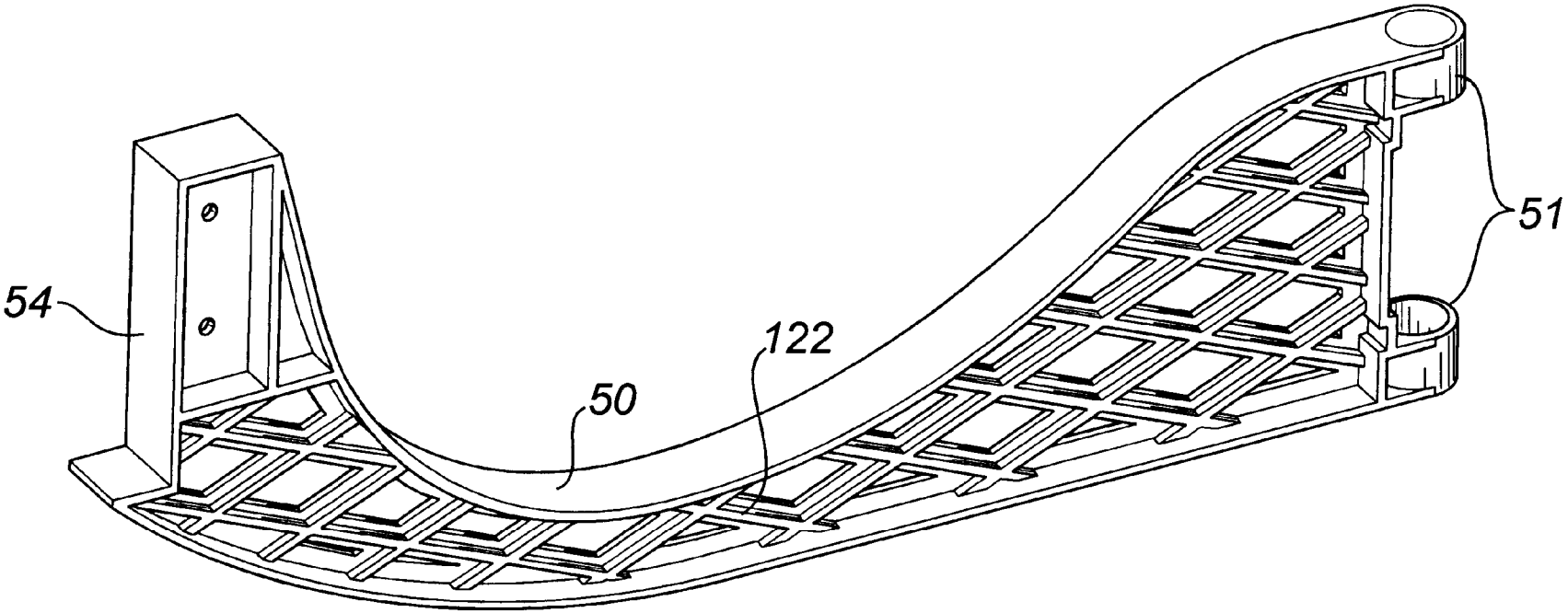
FIG. 9 is a detailed perspective view of a rear member from the foldable goal net support illustrated in FIG. 1.
Figure 10:
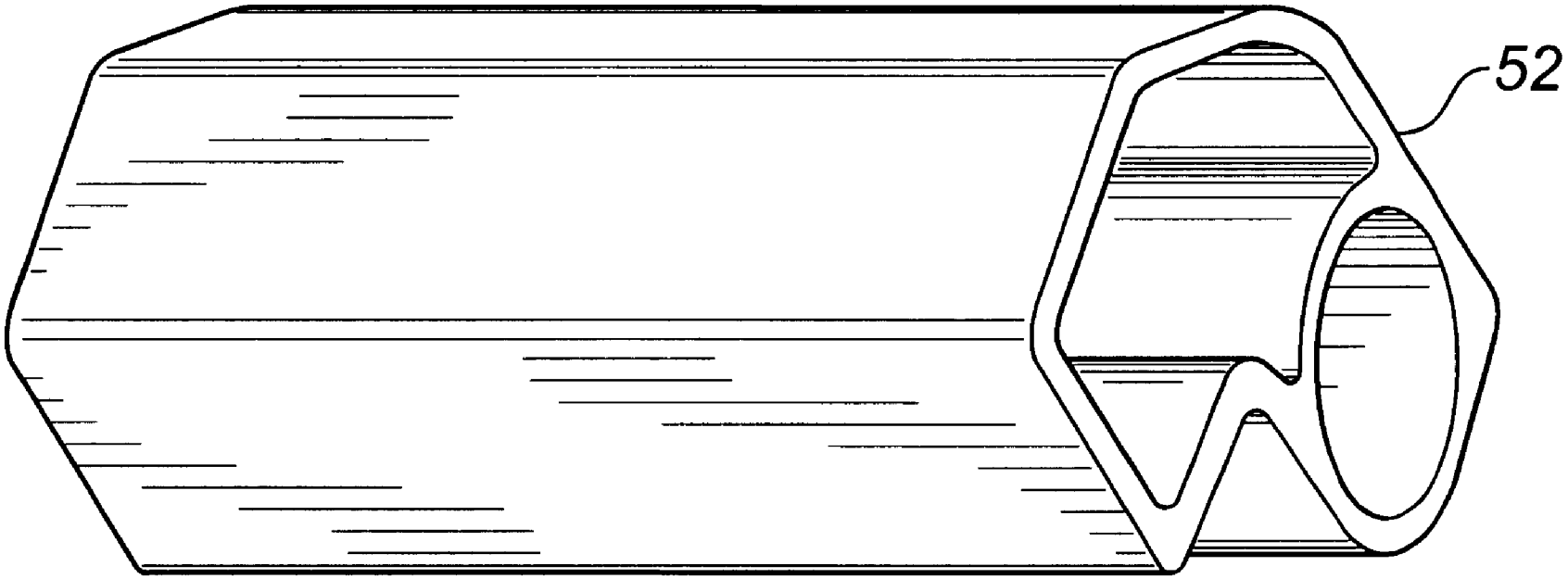
FIG. 10 is a detailed perspective view of a hinge bracket for a rear member from the foldable goal net support illustrated in FIG. 1.
Figure 11:
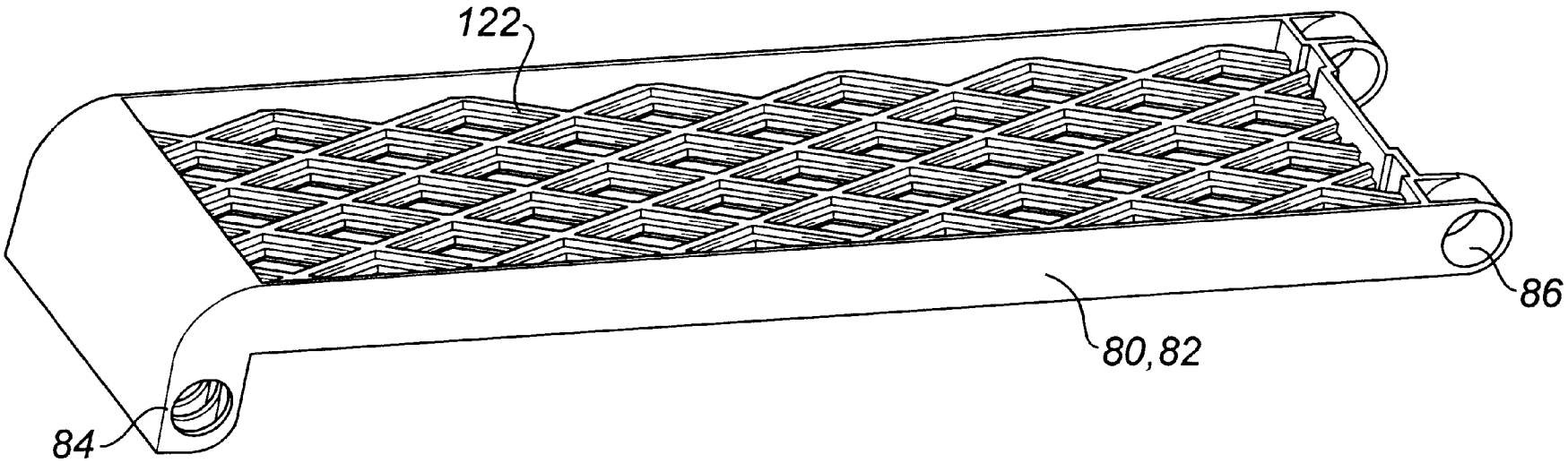
FIG. 11 is a detailed perspective view of a top member from the foldable goal net support illustrated in FIG. 1.
Figure 12:
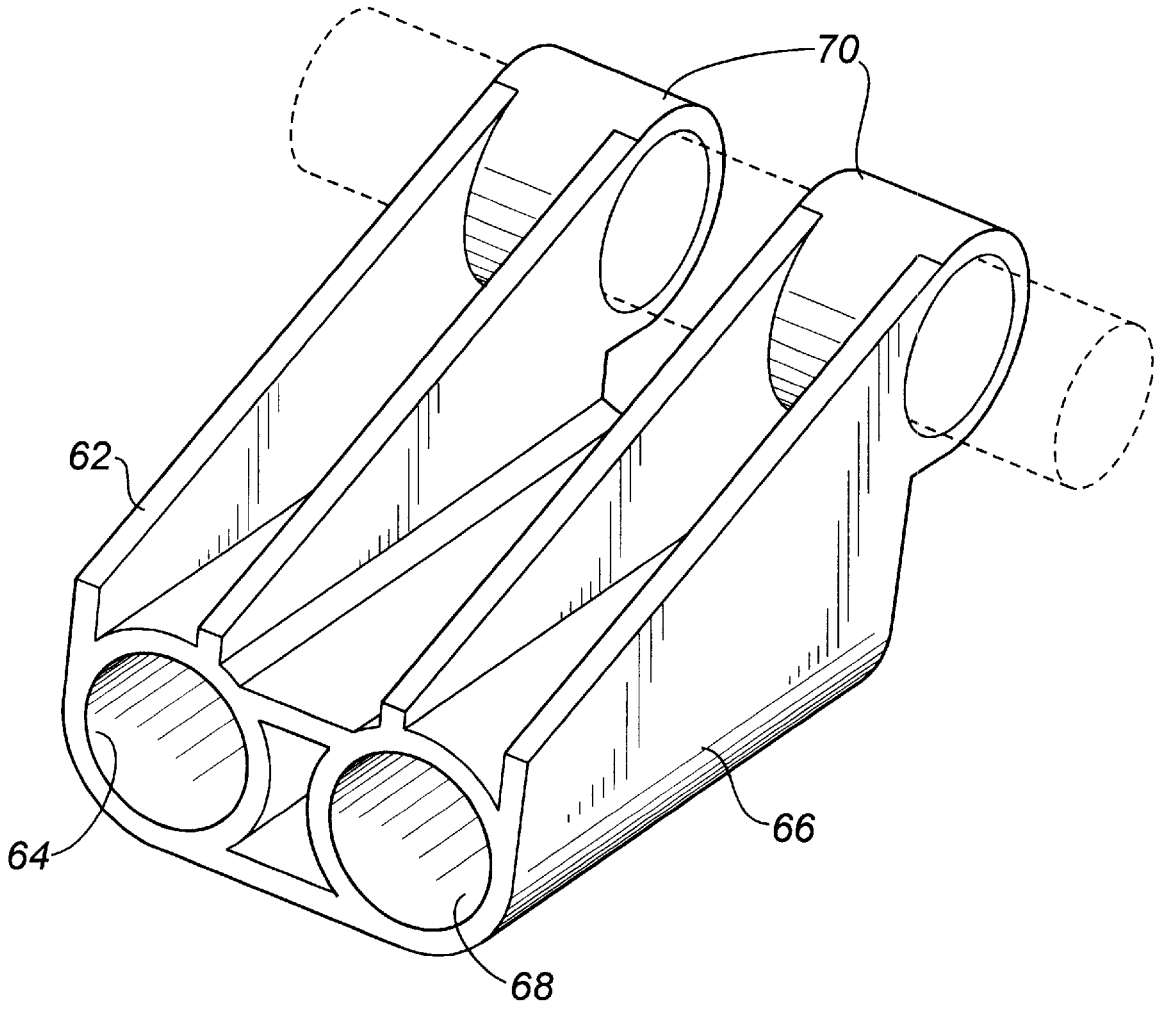
FIG. 12 is a detailed perspective view of a spacer member from the foldable goal net support illustrated in FIG. 1.
Figure 13:
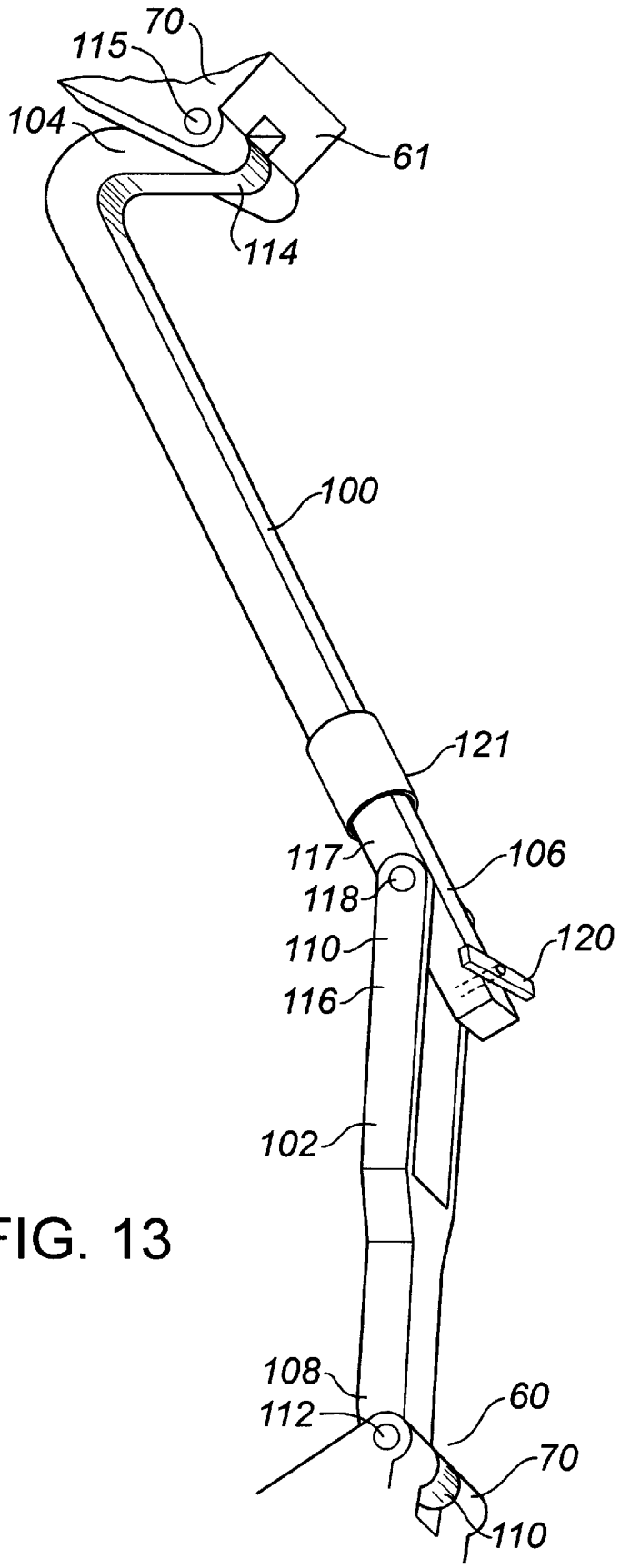
FIG. 13 is a detailed side elevation view of a brace member from the foldable goal net support illustrated in FIG. 1.

Referring to FIGS. 1 through 4, foldable goal net support 10 includes a rigid first side section 12, a rigid second side section 14, a rear section 16, a front section 18 and a brace member 20. Each of first side section 12 and second side section 14 include a side panel 22 illustrated in FIG. 7 and a hinge bracket 24 illustrated in FIG. 8. Referring to FIG. 7, hinge bracket 24 is secured to mounting surface 26 of side panel 22 and a hinge connection 27 is remote from mounting surface 26. Referring to FIG. 1, when hinge bracket 24 is secured to side panel 22, first side section 12 can be considered for purposes of orientation to have a horizontally extending portion 28 terminating in a bracket attachment end 30 and a vertically extending portion 32 terminating in a top end 34. Second side section 14, similarly, has a horizontally extending front portion 36 terminating in a bracket attachment end 38 and a vertically extending portion 40 terminating in a top end 42. Rear section 16 includes a first rear member 44, a second rear member 46, and a rear spacer member 60 disposed between first rear member 44 and second rear member 44. Both first rear member 44 and second rear member 46 include a panel 50 illustrated in FIG. 9 and a hinge bracket 52 illustrated in FIG. 10. Referring to FIG. 9, hinge bracket 52 is secured to mounting surface 54 of panel 50. Panel 50 has a hinge connection 51. Referring to FIG. 6, by securing hinge bracket 52 to hinge bracket 24 with a pin 53, a first end 56 of first rear member 44 is coupled for pivotal movement about a substantially horizontal axis to first side section 12. Similarly, by securing hinge bracket 52 to hinge bracket 24 with a pin 53, a first end 58 of second rear member 46 is coupled for pivotal movement about a substantially horizontal axis to second side section 14. There is both a rear spacer member 60 and a front spacer member 61 which are identical in construction. Referring to FIG. 12, each of rear spacer member 60 and front spacer member 61 has a first end 62 with a first hinge connections 64, a second end 66 with a second hinge connection 68 and a transverse hinge connection 70. Referring to FIG. 1 and 3, by connecting hinge connection 51 on panel 50 with first hinge connection 64 with a pin 72, a second end 74 of first rear member 44 is coupled for pivotal movement about a substantially horizontal axis to first end 62 of front spacer member 60. Similarly, by mating hinge connection 51 on panel 50 with second hinge connection 68 and securing them together by means of a pin 76, a second end 78 of second rear member 46 is coupled for pivotal movement about a substantially horizontal axis to second end 66 of front spacer member 60. Front section 18 includes a first front member 80, a second front member 82, with front spacer member 61 disposed between first front member 80 and second front member 82. Referring to FIG. 11, both first front member 80 and second front member 82 have hinge connections 84 and 86 at opposed ends. Referring to FIGS. 1 and 3, by connecting hinge connection 84 to hinge connection 27 and with a pin 90 a first end 88 of first front member 80 is coupled for pivotal movement about a substantially horizontal axis at top end 34 of vertically extending portion 32 of first side section 12. Similarly, by connecting hinge connection 84 to hinge connection 27 and with a pin 92, a first end 94 of second front member 82 is coupled pivotal movement about a substantially horizontal axis at top end 42 of vertically extending portion 40 of second side section 14. By coupling hinge connection 86 to first hinge connection 64 with a pin 96, a second end 98 of first front member 80 is coupled for pivotal movement about a substantially horizontal axis to first end 62 of front spacer member 61. Similarly, by coupling hinge connection 86 to second hinge connection 68 with a pin 97, second end 99 of second front member 82 is coupled for pivotal movement about a substantially horizontal axis to second end 66 of front spacer member 61. Brace member 20 extends between rear section 16 and front section 18. Referring to FIG. 13, brace member 20 includes a front portion 100 and a rear portion 102. Front portion 100 has a first end 104 and a second end 106. Rear portion 102 has a first end 108 and a second end 110. First end 108 of rear portion 102 has a hinge connection 110 connected to transverse hinge connection 70 with a pin 112 for pivotal movement about a substantially horizontal axis to rear spacer member 60. First end 104 of front portion 100 has a hinge connection 114 connected to transverse hinge connection 70 with a pin 115 for pivotal movement about a substantially horizontal axis to front spacer member 61. Second end 106 of front portion 100 has a hinge connection 117 connected to a hinge connection 116 at second end 110 with a pin 118 for pivotal movement about a substantially horizontal axis to rear portion 102. A pivotal stop 120 is positioned at second end 106 of front portion 100. Front portion 100 of brace member 20 is longer than rear portion 102. This places creates an over center position that results in gravity acting to maintain pivotal stop 120 in position and thereby maintains brace member 20 as a rigid support. In addition, a sleeve 121 slides over hinge connections 116 and 117 to ensure that a blow to brace member 20 in the vicinity of pin 118 does not cause a premature pivotal collapse of net support 10. It is preferred that rear section 16, front section 18, first side section 12, and second side section 14 all be moulded out of polymer plastic moulded in a lattice configuration, generally indicated by reference numeral 122. This construction provides them with the requisite strength, but makes them lighter than solid panels. It is preferred, but not essential, that means be provided for limiting pivotal movement to 90 degrees of the hinged pivotal connections between the first side section 12 and front section 18, between second side section 14 and front section 18, between first side section 12 and rear section 16 and between second side section 14 and rear section 16. This adds to the stability and rigidity of the structure when the brace member 20 is rigidly set. Referring to FIG. 1, the means used in this embodiment for limiting pivotal movement lies in the construction of the hinge connections. The maximum pivotal position of first side section 12 in relation to first front member 80 is determined when rear end 34 of first side section 12 abuts against first end 88 of first front member 80. Similarly, the maximum pivotal position of second side section 14 in relation to second front member 82 is determined when rear end 42 of second side section 14 abuts against first end 94 of second front member 82. The maximum pivotal position of first rear member 44 is determined when first end 56 of first rear member 44 encounters first side section 12. Similarly, the maximum pivotal position of second rear member 46 is determined when first end 58 of second rear member 46 encounters second side section 14.

Figure 4:
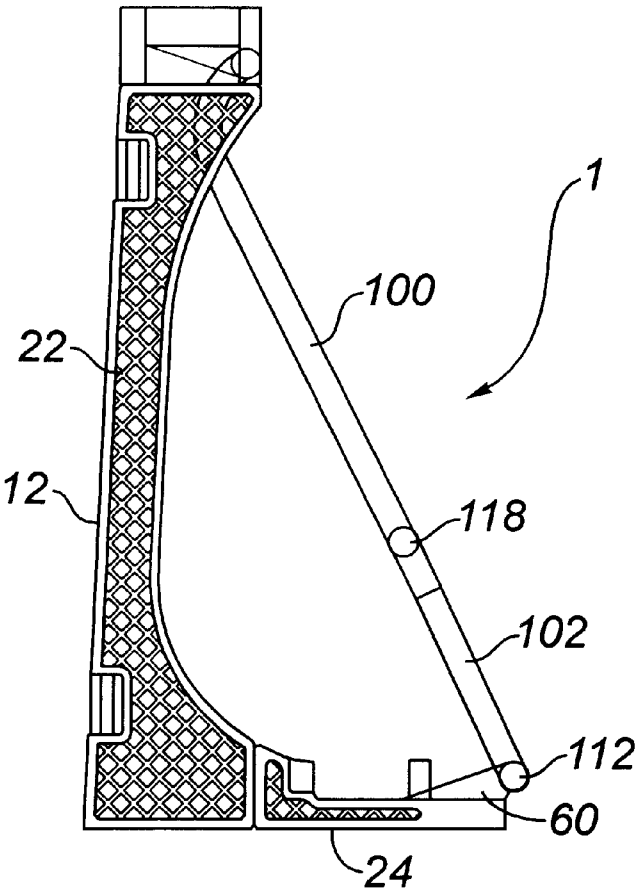
FIG. 4 is a side elevation view of the foldable goal net support illustrated in FIG. 1.
Figure 5:
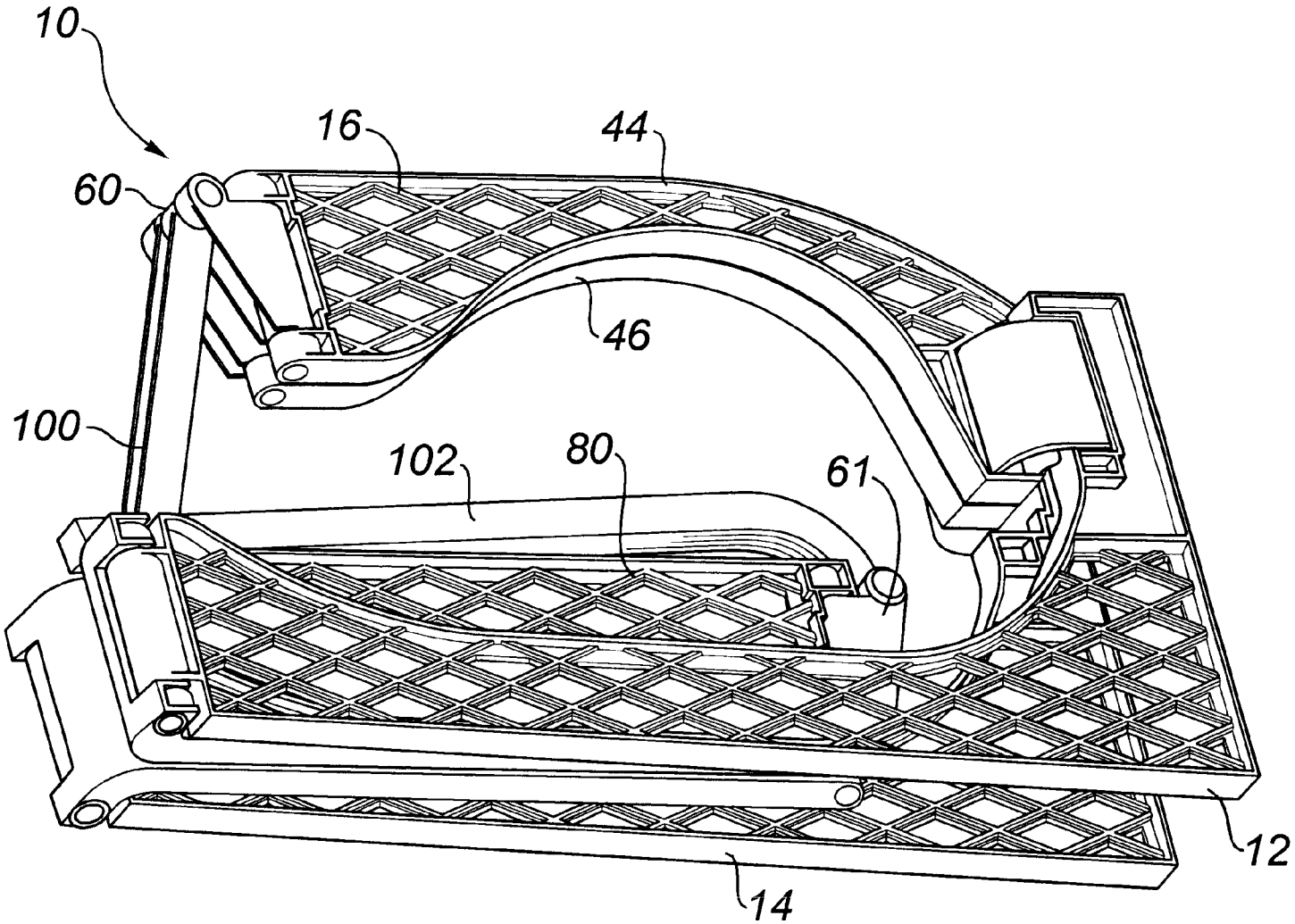
FIG. 5 is a perspective view of a foldable goal net support constructed in accordance with the teachings of the present invention, in a folded position.

The use and operation of foldable goal net support 10 will now be described with reference to FIGS. 1 through 13. Foldable goal net support 10 is transported and stored in the position illustrated in FIGS. 5 and 6. Referring to FIG. 1, in order to use foldable goal net support 10, first rear member 44 and second rear member 46 of rear section 16 are axially aligned, as are first front member 80 and second front member 82 of front section 18. Referring to FIGS. 4 and 13, front portion 100 and rear portion 102 of brace member 20 are then pivoted until pivotal stop 120 is engaged to maintain brace member 20 in a rigid supporting position. Sleeve 121 is then dropped over pivot pin 118. In order to fold foldable goal net support 10, the instructions are reversed. Referring to FIG. 6, front portion 100 and rear portion 102 of brace member 20 are pivoted to release brace member 20 from a supporting position. Rear section 16 and front section 18 may then be folded into the configuration illustrated in FIGS. 5 and 6.

It will be apparent to one skilled in the art that modifications may be made to the illustrated embodiment without departing from the spirit and scope of the invention as hereinafter defined in the claims.

The embodiments of the invention in which an exclusive property or privilege is claimed are defined as follows:

1. Foldable goal net support, comprising:

a rigid first side section having a vertically extending portion terminating in a top end and a horizontally extending portion terminating in a bracket attachment end;

a rigid second side section having a vertically extending portion terminating in a top end and a horizontally extending portion terminating in a bracket attachment end;

a front section including a first front member, a second front member, and a front spacer member disposed between the first front member and the second front member, a first end of the first front member being coupled by means of a hinge for pivotal movement about a substantially horizontal axis at the top end of the first side section, a first end of the second front member being coupled by means of a hinge for pivotal movement about a substantially horizontal axis at the top end of the second side section, a second end of the first front member being coupled by means of a hinge for pivotal movement about a substantially horizontal axis to a first end of the front spacer member, a second end of the second front member being coupled by means of a hinge for pivotal movement about a substantially horizontal axis to a second end of the front spacer member;

a ground engaging rear section including a first rear member, a second rear member, and a rear spacer member disposed between the first rear member and the second rear member, a first end of the first rear member being coupled by means of a hinge for pivotal movement about a substantially horizontal axis at the bracket attachment end the first side section, a first end of the second rear member being coupled by means of a hinge for pivotal movement about a substantially horizontal axis at the bracket attachment end of the second side section, a second end of the first rear member being coupled by means of a hinge for pivotal movement about a substantially horizontal axis to a first end of the rear spacer member, a second end of the second rear member being coupled by means of a hinge for pivotal movement about a substantially horizontal axis to a second end of the rear spacer member;

means being provided to brace the front section to assume an operative position defining a substantially rectangular opening.

2. The foldable goal net support as defined in claim 1, wherein a brace member extends between the front section and the rear section, the brace member including a front portion and a rear portion, the front portion having a first end and a second end, the rear portion having a first end and a second end, the first end of the rear portion being coupled by means of a hinge for pivotal movement about a substantially horizontal axis to the rear spacer member, the first end of the front portion being coupled by means of a hinge for pivotal movement about a substantially horizontal axis to the front spacer member, the second end of the front portion being coupled by means of a hinge for pivotal movement about a substantially horizontal axis to the second end of the rear portion; and means for limiting pivotal movement between the second end of the front portion of the brace member and the second end of the rear portion of the brace member thereby maintaining the brace member as a rigid support.

3. The foldable goal net support as defined in claim 1, wherein at front section, rear section, first side section, and second side section are all moulded out of a lattice of polymer plastic.

4. The foldable goal net support as defined in claim 2, wherein the means for limiting pivotal movement of the brace member includes a pivotal stop at the pivotal connection between the front portion and the rear portion of the brace member.

5. The foldable goal net support as defined in claim 2, wherein the means for limiting pivotal movement of the brace member includes a sleeve that covers the pivotal connection between the front portion and the rear portion of the brace member.

6. The foldable goal net support as defined in claim 2, wherein the front portion of the brace member is longer than the rear portion, thereby placing the pivotal connection between the rear portion of the brace and the front portion of the brace in an over center position in which gravity acts to maintain the brace in an operative position.

7. The foldable goal net support as defined in claim 1, wherein means is provided for limiting pivotal movement to 90 degrees of the hinge between the first side section and the rear section, the hinge between the second side section and the rear section, the hinge between the first side section and the front section and the hinge between the second side section and the front section.

8. Foldable goal net support, comprising:

a rigid first side section having a vertically extending portion terminating in a top end and a horizontally extending portion terminating in a bracket attachment end;

a rigid second side section having a vertically extending portion terminating in a top end and a horizontally extending portion terminating in a bracket attachment end;

a front section including a first front member, a second front member, and a front spacer member disposed between the first front member and the second front member, a first end of the first front member being coupled by means of a hinge for pivotal movement about a substantially horizontal axis at the top end of the first side section, a first end of the second front member being coupled by means of a hinge for pivotal movement about a substantially horizontal axis at the top end of the second side section, a second end of the first front member being coupled by means of a hinge for pivotal movement about a substantially horizontal axis to a first end of the front spacer member, a second end of the second front member being coupled by means of a hinge for pivotal movement about a substantially horizontal axis to a second end of the front spacer member;

a rear section including a first rear member, a second rear member, and a rear spacer member disposed between the first rear member and the second rear member, a first end of the first rear member being coupled by means of a hinge for pivotal movement about a substantially horizontal axis at the bracket attachment end of the first side section, a first end of the second rear member being coupled by means of a hinge for pivotal movement about a substantially horizontal axis at the bracket attachment end of the second side section, a second end of the first rear member being coupled by means of a hinge for pivotal movement about a substantially horizontal axis to a first end of the rear spacer member, a second end of the second rear member being coupled by means of a hinge for pivotal movement about a substantially horizontal axis to a second end of the rear spacer member;

a brace member extending between the front section and the rear section, the brace member including a front portion and a rear portion, the front portion having a first end and a second end, the rear portion having a first end and a second end, the first end of the rear portion being coupled by means of a hinge for pivotal movement about a substantially horizontal axis to the rear spacer member, the first end of the front portion being coupled by means of a hinge for pivotal movement about a substantially horizontal axis to the front spacer member, the second end of the front portion being coupled by means of a hinge for pivotal movement about a substantially horizontal axis to the second end of the rear portion;

a pivotal stop at the second end of the front portion of the brace member, the front portion of the brace member being longer than the rear portion, thereby placing the pivotal connection between the rear portion of the brace and the front portion of the brace in an over center position such that gravity acts to maintain the pivotal stop in position and thereby maintains the brace member as a rigid support.

9. The foldable goal net support as defined in claim 8, wherein at front section, rear section, first side section, and second side section are all moulded out of a lattice of polymer plastic.

10. The foldable goal net support as defined in claim 9, wherein the means for limiting pivotal movement of the brace member includes a sleeve that covers the pivotal connection between the front portion and the rear portion of the brace member.

11. The foldable goal net support as defined in claim 8, wherein means is provided for limiting pivotal movement to 90 degrees of the hinge between the first side section and the rear section, the hinge between the second side section and the rear section, the hinge between the first side section and the front section and the hinge between the second side section and the front section.

* * * * *